US005218955A

United States Patent [19]

Gueret

[11] Patent Number: 5,218,955

[45] Date of Patent: Jun. 15, 1993

[54] DEVICE FOR MASSAGING THE SKIN, PROVIDED WITH ADJUSTABLE ROTATING ELEMENTS

[75] Inventor: Jean-Louis H. Gueret, Paris, France

[73] Assignee: L'Oreal, Paris, France

[21] Appl. No.: 726,814

[22] Filed: Jul. 8, 1991

[30] Foreign Application Priority Data

Jul. 6, 1990 [FR] France ..... 90 08619

[51] Int. Cl.[5] ..... A61H 15/00

[52] U.S. Cl. ..... 128/57; 128/59

[58] Field of Search ..... 128/57-63, 128/24 R, 25 B

[56] References Cited

U.S. PATENT DOCUMENTS

| | | | |
|---|---|---|---|
| 560,351 | 5/1896 | Goetze | 128/57 |
| 1,071,998 | 9/1913 | Gibbs | 128/57 |
| 1,569,426 | 5/1925 | Krauthoff | 128/57 |
| 1,650,528 | 11/1927 | Mesterton . | |
| 1,999,939 | 4/1935 | Luzzi . | |
| 2,011,471 | 11/1933 | Casagrande | 128/57 |
| 2,641,256 | 6/1951 | Schmidt | 128/57 |
| 2,691,978 | 10/1954 | Kirby . | |
| 4,452,237 | 6/1984 | Lewis | 128/60 |
| 4,751,918 | 6/1988 | Bernard | 128/57 |

FOREIGN PATENT DOCUMENTS

| | | | |
|---|---|---|---|
| 10500 | 4/1980 | European Pat. Off. | 128/57 |
| 657743 | 3/1938 | Fed. Rep. of Germany . | |
| 841207 | 6/1952 | Fed. Rep. of Germany | 128/57 |
| 3215226 | 10/1983 | Fed. Rep. of Germany . | |
| 1335549 | 12/1954 | France . | |
| 1603477 | 5/1971 | France . | |
| 2596983 | 10/1987 | France . | |

*Primary Examiner*—Robert A. Hafer
*Assistant Examiner*—David J. Kenealy
*Attorney, Agent, or Firm*—Cushman, Darby & Cushman

[57] ABSTRACT

The massage device is adapted to be applied to the skin. It is provided with at least two elements (2, 3) each mounted to rotate freely about an associated axis (4, 5) and each generally having the shape of a solid generated by rotation, each axis being connected to the support, the directions of the two axes forming between them an oblique angle beta. The oblique angle beta is between 60° and 170° and the rotating elements (2, 3) are made of a flexible material, and have raised portions the contact ends of which, adapted to be applied to the skin, are spaced in the axial direction and in the peripheral direction of the rotating element.

13 Claims, 6 Drawing Sheets

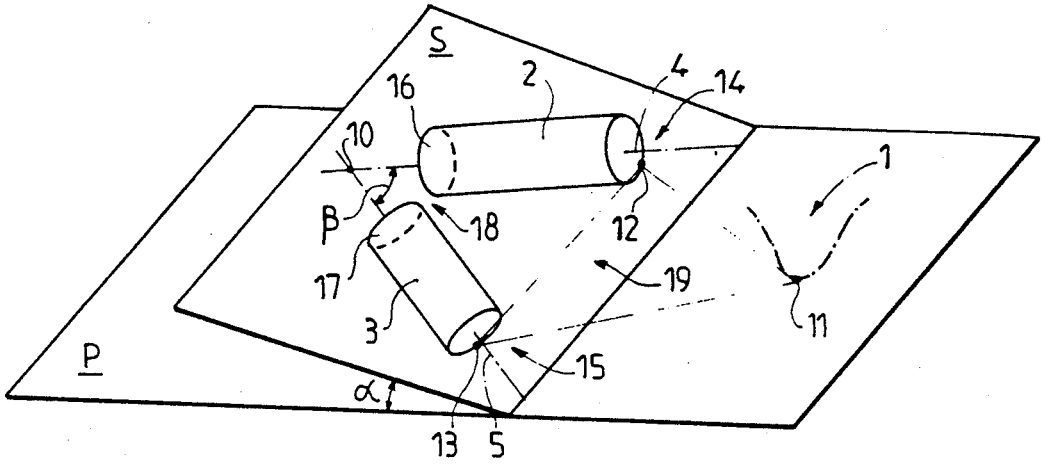
FIG. 1
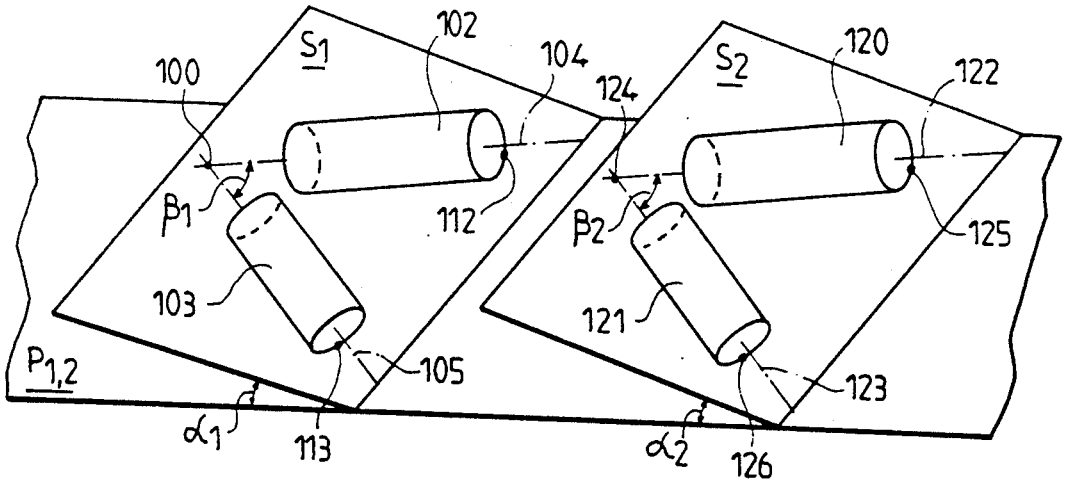
FIG. 1bis

DEVICE FOR MASSAGING THE SKIN, PROVIDED WITH ADJUSTABLE ROTATING ELEMENTS

This invention relates to a massage device adapted to be applied to the skin and provided on one of its faces with at least two elements each mounted to rotate freely about an associated axis, each rotating element generally having the shape of a solid generated by rotation about its associated axis, each axis being connected to the support, the directions of the two axes forming an oblique angle beta.

A massage device of this type is already known in the art, inter alia, from U.S. Pat. No. 1,999,939.

The object of the invention is above all to improve the massaging action obtained with a device of this kind, in particular with a view to obtaining improved tonicity of the skin and a significant reduction of the water and grease present on the surface of the skin after massaging.

It is moreover desirable that the massage device is still simple and economical to manufacture and easy to use.

According to the invention, a massage device of the type specified hereinbefore is characterised in that the oblique angle beta between the directions of the axes of the rotating elements is between 60° and 170° and that the rotating elements are made of a flexible material, especially an elastomer or a thermoplastic elastomer, and have raised portions the contact ends of which, adapted to be applied to the skin, are spaced in the axial direction and in the peripheral direction of the rotating element.

Rotating element or roller profiles of this kind result in a transverse oscillatory movement and a vertical oscillatory movement during massaging. The massage device effects gradual drainage of the skin, although in a discontinuous manner and with vibration.

The contact ends of two successive raised portions in the axial direction are preferably offset in the peripheral direction.

The abovementioned angle beta is advantageously between 115° and 125°. If the massage device comprises several groups of two rotating elements, each angle beta has substantially the same value.

A plane S parallel to the axes of two associated rotating elements is preferably inclined at an angle alpha to a supporting plane P of the massage device.

The axes of the two rotating elements of one group may be coplanar and situated in the plane S, their extensions intersecting at a point of intersection situated on the same side of the supporting plane P as the rotating elements.

The angle of inclination alpha is advantageously between 3° and 20° and preferably between 5° and 7°.

The support of the rotating elements may comprise stop means adapted to come into contact with the skin, these means being capable of resting via at least one point of contact against the supporting plane P or reference plane when this plane also contacts each of the rotating elements.

Each rotating element has a longitudinal dimension in the direction of its respective axis at least equal to its largest transverse dimension.

The stop means may be formed by a projection on the face of the support adapted to be placed opposite the skin.

When the rotating elements are arranged in at least one double row of elements, these rotating elements may be arranged in staggered rows.

According to another possibility, with rotating elements arranged in at least one double row, as the axes of the associated elements are coplanar, the planes of one double row of rotating elements are all parallel to one another.

The planes of one double row may be subdivided into a first and a second group, especially equal groups, all of the planes of one group being parallel to one another, and two planes, each of a different group, being symmetrical to one another with respect to a plane perpendicular to the reference plane P.

The planes S of the two groups may be arranged so that a plane S of the first group follows a plane S of the second group alternately.

The points of intersection of four adjacent elements, two of which are in one row and the other two in the other row, may coincide to form one single point of intersection.

Means for adjusting the oblique angle beta of the axes of the rotating elements may be provided.

The rotating elements may be truncated and the angle alpha of the plane S of their axes may be zero.

It has been found that when the angle of inclination alpha is zero, the zone of contact of the truncated rollers in the axial direction has an angle of inclination similar to the angle alpha, not zero, of generally cylindrical rollers.

It should be noted that the elongated rotating elements have ends opposite to those adjacent to the skin which form an outlet opening considerably narrower than the inlet opening. The outlet opening may be between 1 mm and 50 mm and a device to vary the outlet opening may be provided. Two rotating elements cooperating together thus form a type of bottleneck for the skin between them.

In addition to the features described hereinabove, the invention consists of a number of other arrangements which will be discussed in more detail hereinafter in the description of several embodiments given with reference to the accompanying drawings which are in no way limiting and in which:

FIG. 1 is a simplified diagram of the device according to this invention, this device having two rotating elements and supporting means;

FIG. 1 bis is a second simplified diagram of the invention in which the device comprises four rotating elements, two of which form supporting means in order to define with the other two a reference plane;

Figure 6B:
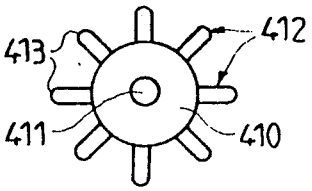
Figure 6A:
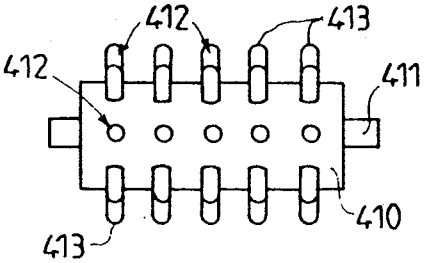

FIG. 6*a* is a side view of a rotating element;

FIG. 6*b* is a left-hand view along the axis of the rotating element of FIG. 6*a;*

Figure 7B:
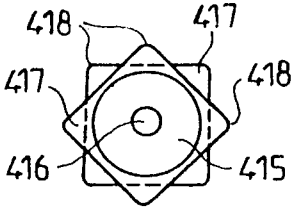
Figure 7A:
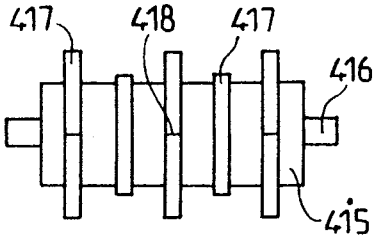

FIG. 7*a* shows another embodiment of a rotating element;

FIG. 7*b* is a left-hand view along the axis of the rotating element of FIG. 7*a;*

Figure 8B:
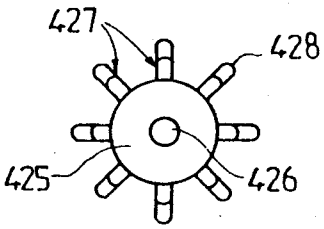
Figure 8A:
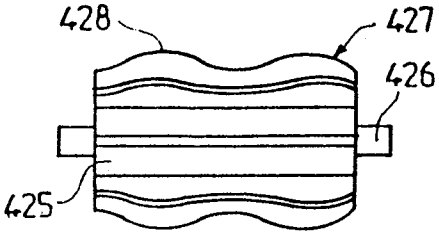

FIG. 8*a* is another embodiment of a rotating element;

FIG. 8*b* is a left-hand view along the axis of the rotating element of FIG. 8*a;*

Figure 9B:
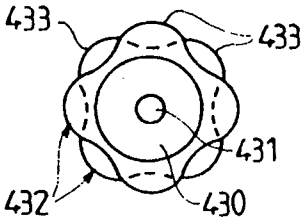
Figure 9A:
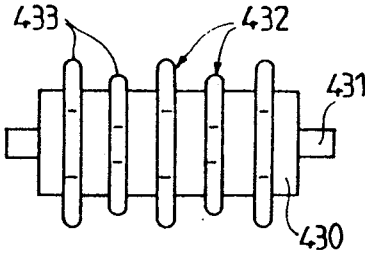

FIG. 9*a* is an embodiment of a rotating element;

FIG. 9*b* is a left-hand view along the axis of the rotating element of FIG. 9*a;*

Figure 10:
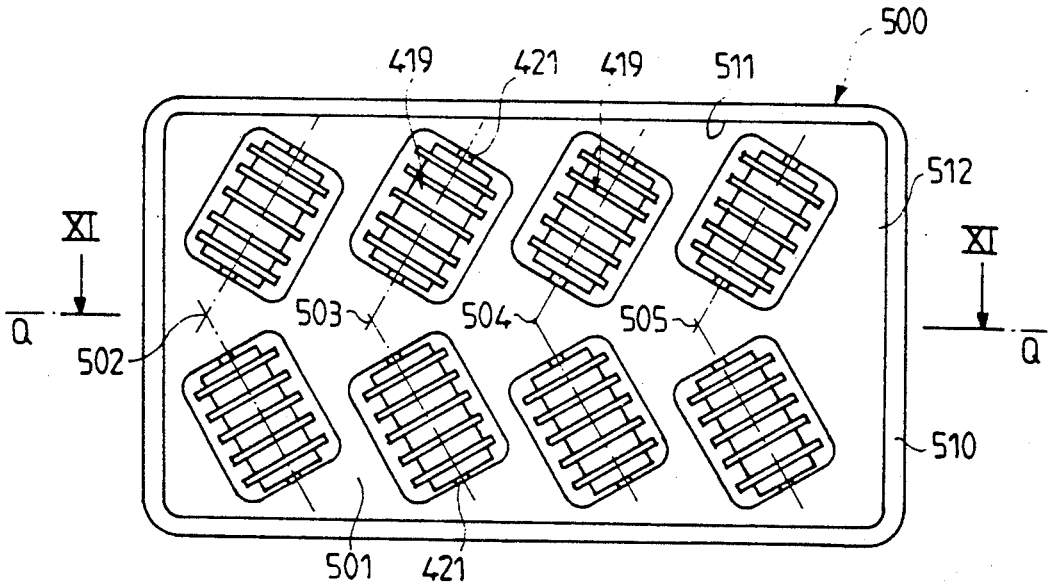
Figure 11:
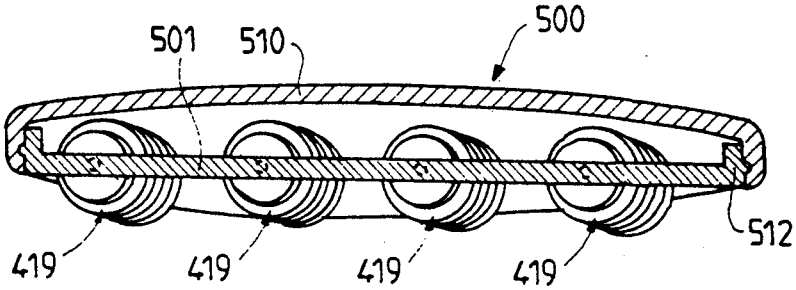
Figure 12:
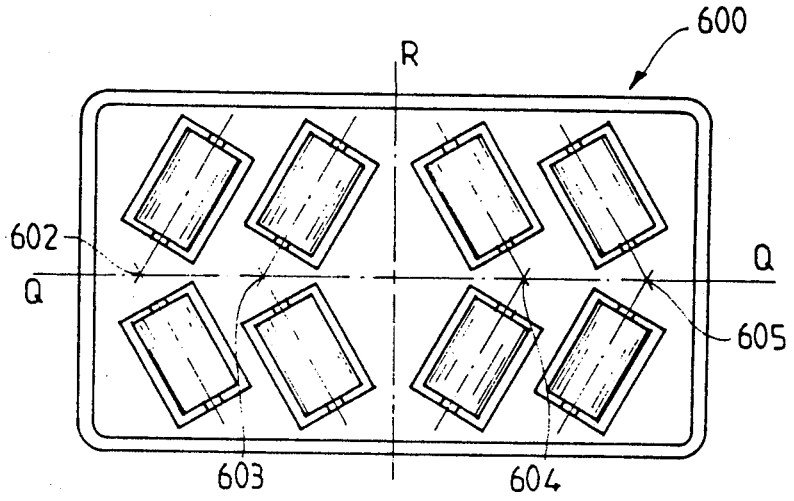
Figure 13:
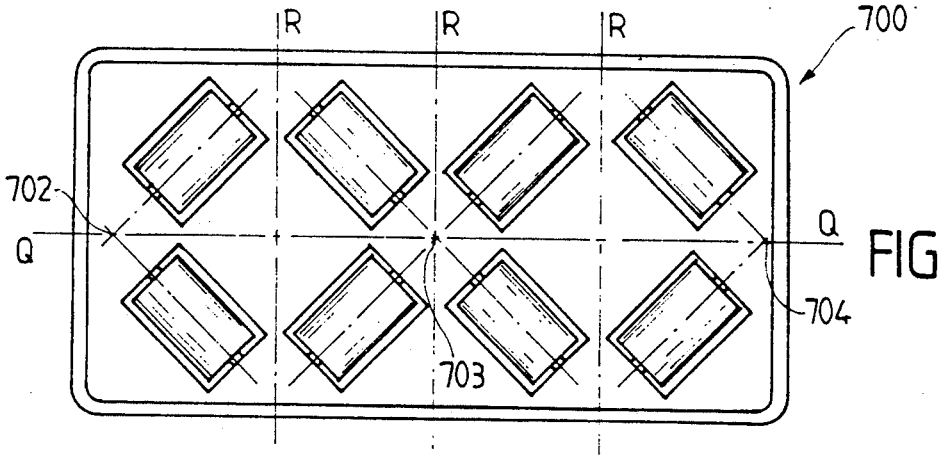
Figure 15:
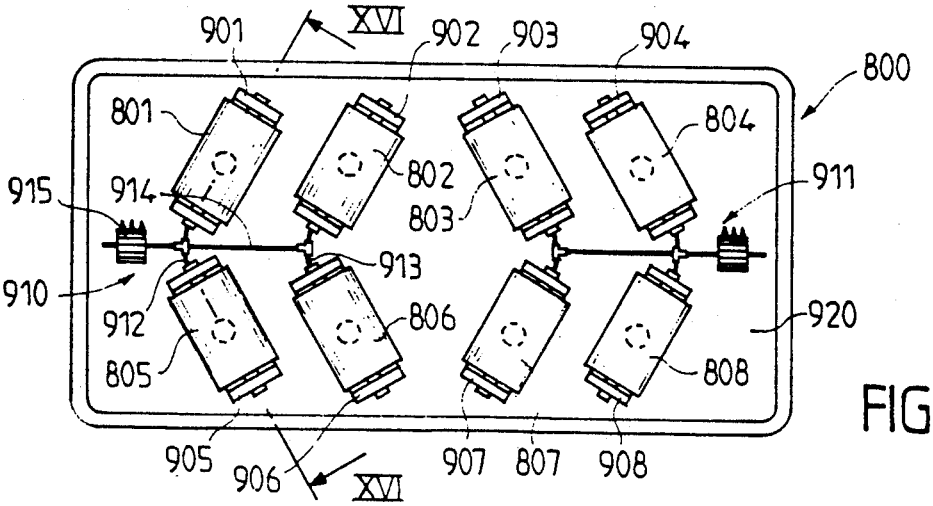
Figure 16:
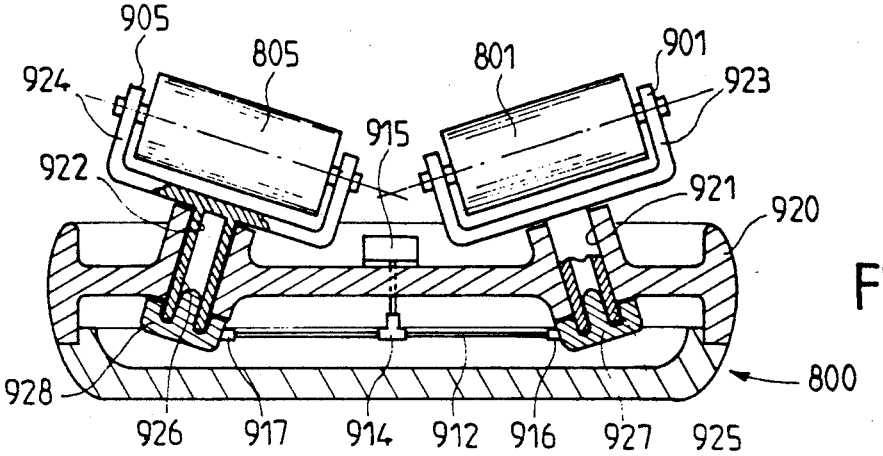
Figure 17:
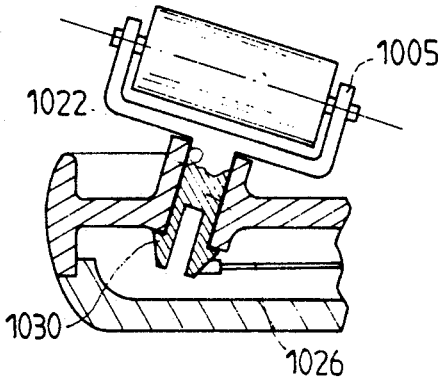
Figure 18:
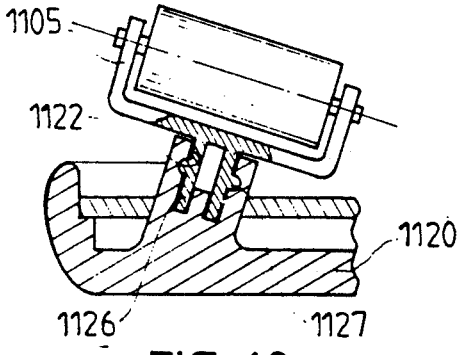
Figure 19:
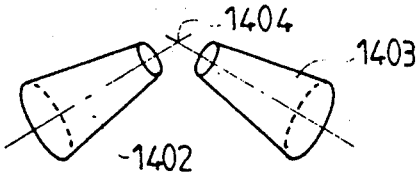
Figure 14:
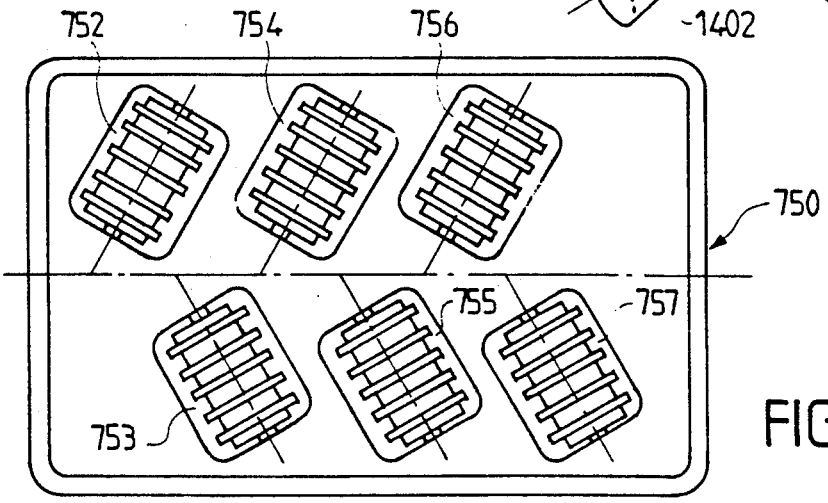

FIG. 10 is a bottom view of a third embodiment of the device according to the invention, this device being provided with eight rotating elements;

FIG. 11 is a sectional view along the line XI—XI of FIG. 10;

FIG. 12 is a bottom view of a fourth embodiment of the device according to the invention;

FIG. 13 is a bottom view of a fifth embodiment of the device according to the invention;

FIG. 14 is a bottom view of a device with rollers arranged in staggered rows;

FIG. 15 is a bottom view of another embodiment of the device according to the invention in which the orientation of the rotating elements is adjustable with the aid of means for adjusting the oblique angle of the axes of the rotating elements;

FIG. 16 is a sectional view, on a larger scale, along the line XVI—XVI of FIG. 15;

FIG. 17 is a partial sectional view of a first variant embodiment of a device comprising one adjustable rotating element;

FIG. 18 is a partial sectional view of a second variant embodiment of a device comprising an adjustable rotating element and, finally, FIG. 19 is a diagrammatic perspective of a pair of rotating elements each having the shape of a truncated cone.

FIG. 1 is a simplified diagram of the device for massaging the skin according to this invention. The support of the device is not shown, with the exception of the supporting means designated by the reference numeral 1. The device comprises two rotating elements in the form of a first roller 2 and a second roller 3. The rollers 2 and 3 are identical and each have the general shape of a right cylinder generated by rotation about a corresponding axis. The roller 2 has an axis designated by the reference numeral 4, while the roller 3 has an axis designated by the reference numeral 5. The axes 4 and 5 are fixed to the support of the device (not shown). By virtue of these axes supported by the support, each roller 2 and 3 is free to rotate about its associated axis. The axes 4 and 5 are generally coplanar and their virtual extensions intersect at a point of intersection designated by the reference numeral 10. The axes 4 and 5 define a plane S in which they form an oblique angle beta. This angle beta is between 60° and 170°. The axes 4 and 5 may not be coplanar, as in the case of FIG. 14 (rotating elements arranged in staggered rows), in which case the angle beta is that formed by directions parallel to the said axes, situated in one plane.

A reference plane P comes into contact at a point 11 with the stop means 1, at a point 12 with the roller 2 and at a point 13 with the roller 3. It will be noted that the points 12 and 13 are each situated on the circular end of each roller 2, 3 furthest away from the point of intersection 10 of the extensions of the axes 4 and 5. The plane P forms a dihedral angle alpha with the plane S which contains the two axes 4 and 5, these two axes being situated on one side of the plane P. The angle alpha may vary between 3° and 20°.

Each roller 2, 3 has a longitudinal dimension in the direction of its respective axis 4 and 5 greater than its largest transverse dimension which in this case is uniform and equal to the diameter of the roller. The two upper circular ends 16 and 17 of the rollers 2 and 3 closest to the point of intersection 10 are closer to one another than the corresponding lower ends 14 and 15. The upper ends 16, 17 define between them an outlet opening 18 which can vary between 1 and 50 mm, while the lower ends 14, 15 define between them an inlet opening 19 of dimensions considerably greater than the outlet opening 18.

The rollers 2, 3 are made of flexible material, especially an elastomer or a thermoplastic elastomer. The hardness of the rollers is preferably between 25 and 90 Shore A. The rollers 2, 3 have raised portions (as described in more detail with reference to FIGS. 6*a* to 9*b*) the contact ends of which, adapted to be applied to the skin, are spaced in the axial direction and in the peripheral direction of the rotating element. The contact ends of two successive raised portions in the axial direction are preferably offset in the peripheral direction (see FIGS. 7*b* and 9*b*).

The rollers arranged in rows may be of variable hardness.

FIGS. 6*a* to 9*b* show the various shapes of rollers for the device according to this invention in more detail. The lateral surfaces of the rollers of FIGS. 6*a* to 9*b* have raised portions. All of these rollers have a base surface in the shape of a right cylinder generated by rotation, giving rise to different raised portions extending in a radial direction with respect to the axis of rotation of the roller.

In a general manner, the larger these raised portions and the more they are spaced from one another in the longitudinal direction, the smaller the angle alpha and therefore the closer it will come to the lower permissible limit of 3°. In the puckering action of the roller, the skin must come into contact with a certain longitudinal extent of the roller. These rollers of FIGS. 6*a* to 9*b* provided with these various longitudinally offset protuberances have a vibratory and oscillatory action on the skin in addition to their puckering/rolling action or, in the other direction, relaxing of the skin. This set of results has never been obtained with the devices of the prior art.

The rotating element shown in FIGS. 6*a* and 6*b* is a cylinder 410 generated by rotation about an axis 411. This cylinder 410 generated by rotation is extended in a radial direction by a plurality of spaced pins 412. These pins are inscribed in a plurality of envelopes each having the shape of a circular disc of the same dimensions, these geometric envelopes being regularly spaced from one another in the longitudinal direction. In this embodiment, the pins have equal dimensions and, consequently, the ends 413 of all of the pins are inscribed in an envelope in the shape of a cylinder generated by rotation about the axis 411. These ends 413 are spaced in the axial direction and in the peripheral direction of the rotating element.

The rotating element of FIGS. 7*a* and 7*b* is a cylinder 415 generated by rotation about the axis 416. This cylinder is extended in a radial direction by raised portions generally having the shape of squares 417 with rounded edges 418. These squares are spaced at regular intervals from one another in the axial direction of the roller. All of the squares 417 have a substantially identical shape, but the edges 418 of two successive squares are offset angularly by an angle $\pi/4$ about the axis of rotation 416.

The rounded vertices of the edges 418 are all inscribed in an envelope generated by rotation about the axis 416.

The rotating element illustrated in FIGS. 8*a* and 8*b* shows a cylinder 425 generated by rotation about an axis 426. The cylinder 425 is extended in a radial direction by a plurality of waves 427 each forming a continuous wall the median plane of which passes through the axis 426. These walls 427 have a radial edge 428 in the form of corrugations extending in the longitudinal direction defined by the axis 426.

The rotating element of FIGS. 9*a* and 9*b* comprises a cylinder 430 generated by rotation about an axis 431. This cylinder 430 is extended in a radial direction by a plurality of raised portions 432 each having the shape of a disc having a series of radially extending waves. Each disc has an axis of fourfold symmetry oriented in the longitudinal direction defined by the axis 431. The waves 433 of two successive discs are offset angularly by an angle substantially equal to $\pi/4$ about the axis 431.

FIG. 1 bis is a second simplified diagram in which the stop means have been replaced by a second pair of rotating elements. The features analogous to those of FIG. 1 are designated by reference numerals increased by 100. Therefore, this drawing shows two rollers 102, 103, the axes 104, 105 of which intersect at a point 110 forming an angle beta 1 as described hereinbefore. These two axes 104, 105 define a plane S1.

The device, the support of which is not shown, also comprises two other rotating elements 120, 121, the extensions of the concurrent axes 122, 123 of which intersect at a point 124 forming an angle beta 2 and together defining a plane S2.

The planes S1, S2 are approximately parallel or form between them an angle the maximum value of which does not exceed 17°.

The four rollers 102, 103, 120, 121, having axes 104, 105, 122, 123, are mounted to rotate freely with respect to the support so that they each come into contact with a plane P 1, 2 at a corresponding point of contact 112, 113, 125, 126. This plane P 1, 2 forms an angle alpha 1 with the plane S1 and an angle alpha 2 with the plane S2, the angles alpha being between 3° and 20°.

In one plane S, the axes of the rotating elements form an angle beta between 60° and 170°.

Figure 2:
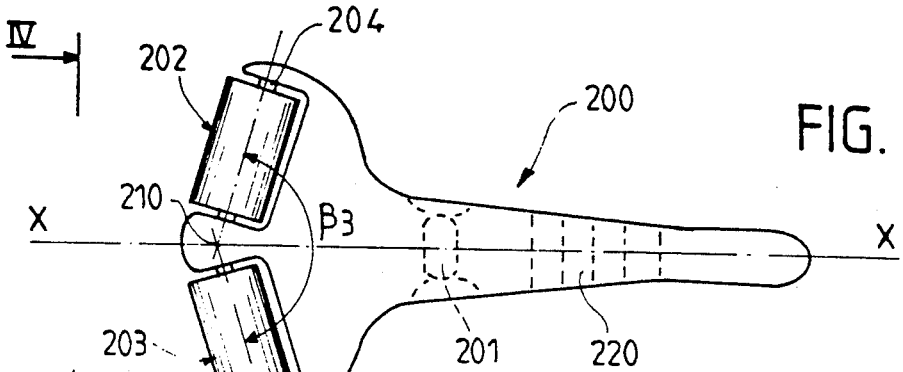
FIG. 2 is a diagrammatic top view of a first embodiment of a device provided with two rotating elements and a stop serving as supporting means.
Figure 3:
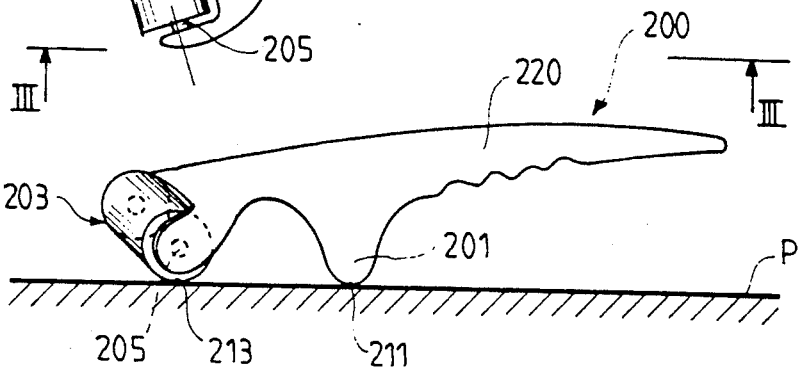
FIG. 3 shows the device of FIG. 2 viewed along the line III—III of FIG. 2.
Figure 4:
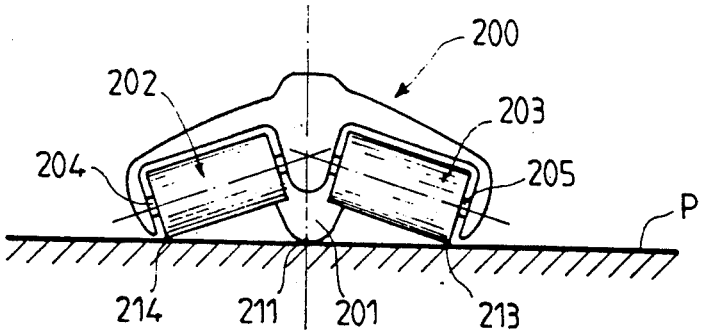
FIG. 4 is a view of the device of FIG. 2 along the line IV—IV of FIG. 2.

FIGS. 2 to 4 show a first embodiment of the device according to the invention. The features analogous to those of FIG. 1 are designated by reference numerals increased by 200 compared to those of FIG. 1. The device designated in general by the reference numeral 200 comprises a longitudinal plane of symmetry X—X and comprises a handle 220 that can be gripped by the hand. This handle comprises stop means 201 formed by a projection on the face of the support adapted to be placed opposite the skin. This device is provided with two rotating elements in the form of rollers generally having the shape of cylinders 202 and 203 generated by rotation about respective axes 204 and 205, the virtual extensions of these axes intersecting at a virtual point of intersection 210. These axes together define an angle beta 3 equal to 120°. The rollers 202, 203 and the projection 201 thus come into contact via the points of contact or support 214, 213 and 211 respectively with a plane P. The axes 204, 205 define a plane S (not shown) which forms an angle of inclination alpha with the plane P. This angle alpha is in this case approximately 15°.

The operation of this device is as follows.

This device is pressed against the skin in the manner shown in FIG. 3, the skin thus replacing the reference plane P. The device is held by its handle 220 and is moved in translation over the skin in a direction parallel to the plane of symmetry X—X of the device. When the device is moved towards the right in FIG. 3, the rollers, pressing against the skin and entering slightly therein, roll and slide over the skin with rubbing. This sliding with rubbing results in puckering of the skin which is urged from the zone defined by the large opening of the rollers towards the outlet zone defined by the small opening of the rollers. In addition, the rollers roll over the skin causing rolling thereof. When the device is moved in the other direction the skin is not massaged in the same manner.

The rollers slide, again with rubbing, and roll simultaneously, but the skin undergoes slight stretching or relaxing, still with a rolling action by the rollers.

The device of the invention provided with rollers with the particular profiles described hereinbefore results in a transverse oscillatory movement and a vertical oscillatory movement during massaging. The massage device effects gradual drainage of the skin, although in a discontinuous manner and with vibration.

After massaging with a device according to the invention, improved microcirculation is noted, leading to improved tonicity of the skin and a significant reduction of the water and grease present on the surface of the skin, indicating that after massaging of the skin, the device allows for more rapid penetration of the massaging product into the epidermis. An increase in the elasticity of the skin is also noted.

The massage device is not aggressive with respect to the skin.

Figure 5:
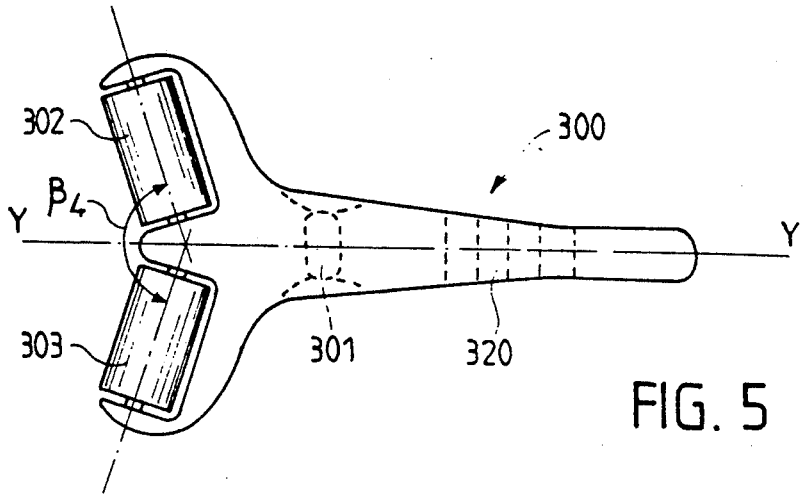
FIG. 5 is a diagrammatic top view of a second embodiment of a device comprising two rotating elements and a stop serving as supporting means.

FIG. 5 shows a second embodiment of a device having two rotating elements formed by rollers. The features analogous to those of FIG. 2 are designated by reference numerals increased by 100 compared to those of FIG. 2. This device designated in general by the reference numeral 300 comprises a handle 320, stop means forming a projection 301 adapted to come into contact with the skin and two rotating elements in the form of rollers 302 and 303.

This device has a longitudinal plane of symmetry Y—Y and if the two devices of FIGS. 2 and 5 are compared by making their respective planes of symmetry X—X and Y—Y coincide with one another, it will be noted that the rollers 302, 303 of the device of FIG. 5 are symmetrical with the rollers 202, 203 of FIG. 2 with respect to a plane perpendicular to the plane X—X or Y—Y.

The oblique angle beta 4 of the device of FIG. 5 is equal to the oblique angle beta 3 of the device of FIG. 2. The angles of inclination alpha are not shown, but for reasons of symmetry they are equal. This indicates that the rollers of the device of FIG. 5 assume a position on the skin which is symmetrical with respect to the position of the rollers of FIG. 2 and that, consequently, the action of the device according to FIG. 5 will be substantially identical to that of the device of FIG. 2, the rolling/puckering action of the device of FIG. 5 being obtained by displacement towards the left, while the same rolling/puckering action is obtained by displacement towards the right in the case of the device of FIG. 2.

FIGS. 10 and 11 show a third embodiment of the device according to this invention. This device is provided with eight identical rotating elements 419 which can be seen in FIGS. 9*a* and 9*b*. This device designated in general by the reference numeral 500 comprises a frame 501 receiving the ends of the axes 421 of each roller 419.

These rollers are arranged generally in two parallel longitudinal rows along the largest dimension of the frame 501. All of the rollers 419 are mounted to rotate freely on the frame 501 so that they each have a point of contact with a plane P not shown here. A roller 419 of one row is associated with a roller 419 of another row so that their two axes of rotation define a plane S not shown in FIGS. 10 and 11.

The oblique angles beta of the axes of the rollers are all equal and these axes intersect at a plurality of points of intersection 502, 503, 504, 505. All of these points together define a straight line contained in a plane Q substantially perpendicular to the median plane of the frame 501.

The rollers 419 of one row are symmetrical to the rollers 419 of the other row with respect to this plane Q. In addition, the rollers of one row are arranged spaced in a regular manner in the longitudinal direction of the frame.

The frame 501 and the rotating elements 419 are covered by a body element 510 forming a cover and a gripping element for the hand of the operator. This body element 510 is made integral with the lateral ends 511 and longitudinal ends 512 of the frame 501.

By virtue of these constructional features, this device will result in substantially identical action over a flat surface portion of the skin by each of the associated pairs of these rollers.

When the device operating as illustrated in FIG. 11 is displaced towards the right, it will cause rolling/puckering of the skin, while, displaced towards the left, it will cause relaxing and rolling of the latter.

FIG. 12 shows a fourth embodiment of the device according to the invention. This device designated in general by the reference numeral 600 has eight rotating elements arranged in two longitudinally directed rows. The extensions of the axes of the rotating elements cooperating together intersect in pairs at a plurality of points of intersection 602, 603, 604 and 605 in a longitudinal direction.

As illustrated in FIG. 12 moving from left to right in the longitudinal direction, it will be seen that the first two planes S corresponding to the points 602 and 603 are parallel to one another and define a first group of rotating elements and that the planes S defined by the points of intersection 604, 605 are parallel to one another and form a second group. The points of intersection 602, 603, 604 and 605 are on a line belonging to a plane Q perpendicular to the plane P parallel to the plane of the drawing. Each element of one longitudinal row is arranged symmetrically with respect to this plane Q with another corresponding element of another row. The two preceding groups are themselves symmetrical with respect to a plane R perpendicular both to the plane Q and the plane P. The plane R and the plane Q intersect along a straight line perpendicular to the plane P (not shown) forming an axis of twofold symmetry for the device 600.

This device has the advantage of giving an identical massaging action of the skin irrespective of the direction of its longitudinal displacement over the skin.

FIG. 13 is a fifth embodiment of the device according to the invention. The device designated in general by the reference numeral 700 is provided with eight rotating elements the oblique angles and angles of inclination of which as defined hereinbefore are identical. The extensions of the axes of these rotating elements intersect respectively at the points 702, 703, 704. The points of intersection of the four central adjacent rotating elements coincide to form the single point of intersection 703.

This variant embodiment defines an oblique angle beta and an angle of inclination alpha which are dependent on one another. The points of intersection 702, 703, 704 belong to one straight longitudinally directed line, and this straight line defines a plane Q perpendicular to the plane P parallel to the plane of the drawing.

In this embodiment, the rollers of one row are symmetrical to the rollers of another row with respect to this plane Q. Moreover, the planes S defined by the axes and observed successively in a longitudinal direction are in alternation. Starting from the left of the drawing, the first plane S is symmetrical to the second plane S with respect to a plane R perpendicular to the plane Q and to the plane P. Similarly, the second plane S is symmetrical to the third plane S with respect to a plane R perpendicular to the plane Q and to the plane P and, likewise, the third plane S is symmetrical to the fourth plane S with respect to a plane R perpendicular to the plane Q and the plane P. The four central adjacent elements in this device are arranged along an axis of fourfold symmetry defined by the intersection of the planes Q with the central plane R. Consequently, these four rollers operate in the same manner in the longitudinal direction or in the transverse direction perpendicular thereto.

It is possible to produce a massage device containing a plurality of four rotating elements associated in this manner. As these elements associated in this manner form a sort of mesh repeated in the longitudinal and transverse directions of the device, the massaging action of the rotating elements of this device is then substantially identical so that the device can be moved in a longitudinal or transverse direction.

FIG. 14 shows a variant embodiment 750 comprising two rows of rollers 752, 754, 756 and 753, 755, 757, offset in staggered rows in relation to one another. The axes of the rollers 752, 754, 756 of one row are parallel to one direction, while the axes of the rollers 753, 755, 757 of the other row are parallel to another direction forming the oblique angle beta with the first direction. A plane parallel to the two directions has an angle of inclination alpha with respect to the supporting plane of the device. In the example of FIG. 14, the device comprises six rollers. The number of rollers could of course be other than six.

FIGS. 15 and 16 show another embodiment of the device according to the invention. The device designated in general by the reference numeral 800 comprises eight rotating elements arranged approximately in the orientation of those already indicated in FIG. 12.

A first row is formed successively by the elements 801, 802, 803 and 804. The second longitudinal row is formed by the elements 805, 806, 807 and 808. Each pair of elements 801, 805; 802, 806; 803, 807; 804, 808 defines one angle of inclination alpha. Each rotating element is mounted on a respective support 901, 902, 903, 904, 905, 906, 907 and 908. These supports are each mounted to rotate about an axis perpendicular to the plane S defined by each pair of rollers.

The first group of rollers 801, 802, 805 and 806 is connected to first means 910 for adjusting the oblique angle. The second group of rollers 903, 904, 907, 908 is connected to second means 911 for adjusting their oblique angle. The features of the first means 910 are identical to those of the second means 911.

The first adjusting means 910 comprise two elastically flexible plates 912, 913 joining respectively in pairs the supporting elements 901 to 905 and 902 to 906 of one pair of rollers. Each plate 912, 913 is fixed in the vicinity of its centre to a rod 914 sliding in the longitudinal direction. This rod 914 is slidably mounted in a stop 915 and can be locked in several sliding positions. Different oblique angles correspond to these different locking positions for the associated rotating elements 801, 802, 805 and 806.

The second adjusting means 911 have exactly the same structure as the first locking means described hereinabove and, consequently, they too allow the oblique angle of the associated rollers 803, 804, 807 and 808 to be adjusted to several values. It is still possible to give all of these rotating elements substantially the same oblique angle beta.

FIG. 16 shows in more detail how the supporting elements 901, 905 are hinged on to the frame 920 of the device. This frame comprises bores 921, 922, the axis of which is perpendicular to the plane S defined by the axes of the rollers 805 and 801. Each supporting element 901, 905 comprises a fork 923, 924 receiving respectively the ends of the axes of each roller 801, 805. Each fork is continued towards the bottom in its central part by a tube 925, 926 penetrating with friction into the corresponding bore 921, 922, projecting beyond the latter. The projecting part of each tube 925, 926 is made integral with a stop 927, 928 which presses respectively against the edges of the bores 921, 922. The fork 923, 924 presses on the other end of the bore 921, 922. Each of the ends 916, 917 of the plate 912 is fixed respectively to a stop 927, 928.

FIG. 17 shows a variant embodiment of an adjustable rotating element, in which the supporting element 1005 comprises a tube 1026 introduced into the bore 1022 of the support and held in position by virtue of pins 1030 projecting radially from the lower end of the bore 1022.

FIG. 18 is a third variant embodiment of an adjustable rotating element. The tube 1126 forming the axis of rotation of the supporting element 1105 comprises a ring projecting over the outer cylindrical surface of this tube 1126, this ring entering into snap engagement with a circular groove formed in the bore 1122 provided in the support 1120. In this embodiment, the adjusting means is not shown.

Finally, FIG. 19 shows a pair of rotating elements 1402, 1403 having axes of rotation the extensions of which intersect at a point of intersection 1404. Each rotating element is in the shape of a truncated cone tapering in the direction of the point of intersection 1404. In the case of truncated rollers of this kind, the angle of inclination alpha selected is advantageously equal to zero. It has been found that under these conditions the zone of contact of the rollers in the axial direction has an angle of inclination similar to the angle alpha.

I claim:

1. Massage device adapted to be applied to the skin, said device having a support and opposite faces and provided on one of its faces with at least two elements each mounted to rotate freely about an associated axis, each rotating element generally having the shape of a solid generated by rotation about is associated axis, each axis being connected to the support, the directions of the two axes forming between them an oblique angle beta, characterised in that the oblique angle beta is between 60° and 170° and that the rotating elements (410, 415, 425, 430) are made of a flexible elastomer material, and have raised portions (412, 417, 427, 432) having contact ends, the contact ends (413, 418, 428, 433) being adapted to be applied to the skin, and being spaced along said respective axis and about the periphery of each rotating element; each rotating element having a longitudinal dimension parallel to said associated axis and a transverse dimension, said longitudinal dimension being at least equal to the transverse dimension, said associated axes of each said rotating element defining a plane with said plane being inclined at an angle alpha relative to a reference plane of application of said device, said angle alpha being between 3° and 20°, said support including a stop means for coming into contact with the skin and for retaining the plane defined by the rotating elements at said angle alpha relative to the reference plane, each said rotating element and said stop means having a point of contact with the skin with said three points defining said reference plane.

2. Device according to claim 1, characterised int hat the contact ends (418, 433) of two successive raised portions (417, 432) in the axial direction are offset in the peripheral direction.

3. Device according to claim 1, characterised in that the angle beta is between 115° and 125°.

4. Device according to claim 1, characterised in that a plurality of pairs of rotating elements are provided on said support and for each of the pairs, each angle beta having substantially the same value.

5. Device according to claim 1, characterised in that the angle of inclination alpha is between 5° and 7°.

6. Device according to claim 1, characterised in that the stop means (1) are formed by a projection (201, 301) on the face of the support adapted to be placed opposite the skin.

7. Device according to claim 1 or claim 2, in which the rotating elements are arranged in at least one double row of elements, characterised in that the rotating elements (752, 754, 756; 753, 755, 757) are arranged in staggered rows.

8. Device according to claim 1 or claim 2, in which the rotating elements are arranged in at least one double row of elements, the axes of the associated elements being coplanar with planes (S), characterised in that the planes (S) of one double row of rotating elements (419) are all parallel to one another.

9. Device according to claim 8, characterised in that the planes (S) of one double row are subdivided into a first and a second group, especially equal groups, all of the planes of one group being parallel to one another, and two planes (S), each of a different group, being symmetrical to one another with respect to a plane (R) perpendicular to the reference plane (P).

10. Device according to claim 9, characterised in that the planes (S) of the two groups are arranged so that a plane (S) of the first group follows a plane (S) of the second group alternately.

11. The device as claimed in claim 1 wherein said transverse dimension increases along said respective axis and said longitudinal dimension is at least equal to the largest transverse dimension.

12. Device according to claim 10 wherein the axes of four adjacent elements interesect at a point where two of the elements are disposed in one row and the other two elements of the four adjacent elements are in another row.

13. Device according to claims 1 or 2, wherein said device comprises means for adjusting the oblique angle beta of the axes of the rotating elements.

* * * * *